US006021612A

United States Patent [19]

Dunn et al.

[11] Patent Number: 6,021,612

[45] Date of Patent: Feb. 8, 2000

[54] SOUND ABSORPTIVE HOLLOW CORE STRUCTURAL PANEL

[75] Inventors: Stanley E. Dunn; Joseph M. Cuschieri, both of Boca Raton, Fla.

[73] Assignee: C&D Technologies, Inc., Boca Raton, Fla.

[21] Appl. No.: 08/678,365

[22] Filed: Jul. 16, 1996

Related U.S. Application Data

[63] Continuation-in-part of application No. 08/525,184, Sep. 8, 1995, abandoned.

[51] Int. Cl.[7] ..... E04B 1/82

[52] U.S. Cl. ..... 52/144; 52/145; 52/793.1; 52/787.11; 181/286; 181/288; 181/290; 181/292

[58] Field of Search ..... 52/144, 145, 793.1, 52/793.11, 795.1, 787.11; 181/286, 288, 290, 291, 292, 293

[56] References Cited

U.S. PATENT DOCUMENTS

| | | |
|---|---|---|
| 1,398,209 | 11/1921 | Van Bavegem . |
| 1,535,690 | 4/1925 | Silmar . |
| 1,619,570 | 3/1927 | Duchemin . |
| 1,660,745 | 2/1928 | Delaney . |
| 1,841,586 | 1/1932 | Garrett . |
| 1,963,979 | 6/1934 | Garreth . |
| 2,305,684 | 12/1942 | Foster . |
| 2,370,638 | 3/1945 | Crowe . |
| 2,655,710 | 10/1953 | Roensch et al. . |
| 2,668,788 | 2/1954 | Waldherr . |

(List continued on next page.)

OTHER PUBLICATIONS

Proudfoot advertisement—pp. 1–8 ©1993.

Transportation Research Record 740, pp. 10–13—Transportation Research Board, National Academy of Sciences.

Engineering Principles of Acoustics, Douglas D. Reynold, section 10.3, pp. 390, 391.

Noise Control Engineering Journal, vol. 37, No. 1, Jul.–Aug. 1991, pp. 5–11.

Florida Department of Transportation—Sound Barrier Criteria, pp. 1–10.

IAC Noiseshield Transportation Sound Barriers, advertisement of Industrial Acoustics Company, 7 pages.

The Wall Journal, No. 14, Jul./Aug. 1994, cover page, p. 5.

The Wall Journal, No. 21, Jan./Feb. 1996, pp. 8–13.

The Wall Journal, No. 22, Mar./Apr. 1996, pp. 4, 12, 13, 18, 19, 20, 21.

*Primary Examiner*—Carl D. Friedman
*Assistant Examiner*—Timothy B. Kang
*Attorney, Agent, or Firm*—Malin, Haley, DiMaggio & Crosby, PA

[57] ABSTRACT

A sound absorbing hollow core panel of structural material based on Helmholtz resonator properties consisting of two exterior skins connected by spacers or structural connections and bounded by perimeter skins or structural connections with internal cavity or cavities that communicate with the exterior sound field through a plurality of orifices in one or both exterior skins as well as the perimeter of the panel and that have a plurality of Helmoltz resonators of different shapes and sizes tuned to specific frequencies that control the sound absorption characteristics of the hollow core panel. The internal cavity or cavities are defined by external skins and perimeters as well as internal structural elements acting as interior dividers, interior sub-volumes and perimeter structures, each of which may contain a plurality of orifices for sound communication forming a sequence of first order Helmholtz acoustical resonators with respective natural frequencies for sound absorption. Panels may be assembled with or without selected interior elements or perimeter structures as a basis for infinite flexibility in building sound absorbing walls of selectable sound absorbing characteristics and size. The numbers and geometries of the orifices as well as the sizes of the internal cavities may be varied generally, thus adding to the flexibility of the invention. Sound dissipating material may also be incorporated in the cavities of the panel.

6 Claims, 6 Drawing Sheets

U.S. PATENT DOCUMENTS

| | | | |
|---|---|---|---|
| 2,840,179 | 6/1958 | Junger . | |
| 3,691,714 | 9/1972 | Stepp . | |
| 3,769,767 | 11/1973 | Scott | 52/793.1 X |
| 3,895,152 | 7/1975 | Carlson et al. | 52/793.1 X |
| 4,084,366 | 4/1978 | Saylor et al. | 52/793.1 X |
| 4,319,661 | 3/1982 | Proudfoot . | |
| 4,338,759 | 7/1982 | Swordlow . | |
| 4,402,384 | 9/1983 | Smith et al. . | |
| 4,433,021 | 2/1984 | Riel | 52/793.1 X |
| 4,465,725 | 8/1984 | Riel | 52/793.1 X |
| 4,600,078 | 7/1986 | Wirt . | |
| 4,671,032 | 6/1987 | Reynolds . | |
| 4,821,841 | 4/1989 | Woodward et al. | 181/286 |
| 4,822,661 | 4/1989 | Battaglia . | |
| 4,842,097 | 6/1989 | Woodward et al. | 181/286 |
| 4,998,598 | 3/1991 | Mardin et al. . | |
| 5,205,091 | 4/1993 | Brown . | |
| 5,217,771 | 6/1993 | Schmanski et al. . | |
| 5,369,930 | 12/1994 | Kreizinger . | |

SOUND ABSORPTIVE HOLLOW CORE STRUCTURAL PANEL

This is a continuation-in-part of application Ser. No. 08/525,184, filed Sep. 8, 1995, now abandoned.

BACKGROUND OF THE INVENTION

1. Field of the Invention

This invention relates generally to hollow core wall panels having acoustical absorbing properties through the use of the Helmholtz resonator principle, and more particularly to large panels having additional Helmholtz resonator structures retained within the cavity of the hollow core panel.

2. Description of the Prior Art

The literature teaches through fundamental theory and such U.S. Pat. Nos. as 2,933,146, 3,506,089, 3,837,426, 3,866,001, and 4,562,901 of the practicality of a broad concept of forming building structures through the use of acoustically hard materials such as concrete blocks which can be made to be sound absorbing through the use of the widely known principle of the Helmholtz resonator. Some of these inventions have proven to be commercially successful, though with certain disadvantages associates with their use in terms of cost relative to their non-absorptive counterparts. Furthermore, these inventions offer no advantage in terms of labor savings with regard to ordinary masonry blocks commonly used in the building industry. Finally, the nature of these sound absorbing blocks is such that their design cannot be easily tailored to meet specific design requirements but offer the basis of a product line built on a limited number of configurations and performance inherently limits the size of the cavity and the configuration of the penetrations, restricting the frequency bandwidth over which sound absorption by the block can be achieved. This invention seeks to escape these restrictions by utilizing the whole surface of the wall and the interior cavity formed by the wall surface as one integral cavity which can be tailored to suit the needs of the sound absorption.

The scientific literature teaches that the addition of sound absorption to the surface of noise barriers increases their effectiveness. For example, if highway noise barriers are made sound absorbing, these would be more effective in mitigating highway noise. Sound absorbing highway noise barriers have been constructed of hollow metal case structures with perforated panel facings on the traffic side of the barrier. Fibrous material inside the panels absorbs the sound with the perforated facing acting to protect the panels. These panels act merely on the basis of the fibrous sound absorbing material principle and not through the use of the Helmholtz resonator principle. Due to the use of metal as the primary structural material, these panels are relatively expensive as compared to conventional wood or masonry reflective wall noise barriers.

In addition, some have proposed perfectly hard or perfectly sound absorptive cylinders placed on top of the above highway noise barriers to increase the effectiveness of the barriers, but each of these constructions is very expensive.

It is therefore an object of this invention to provide a sound absorbing hollow core building wall panel for use in exterior and interior applications that can achieve improved absorption performance over pre-selected broadband frequency ranges.

At the same time, it is the purpose of this invention to take advantage of efficiencies achieved through the use of manufacturing and installation methods associated with molded, poured, or otherwise pre-manufactured hollow core building panels over the much smaller single block units. A typical approach by which these hollow core wall panels can be manufactured at a cost comparable to ordinary concrete wall products which are not sound absorbing as described in U.S. Pat. No. 5,369,930. However, the manufacturing process for sound absorbing hollow core wall panels need not be limited to the approach described in this patent. U.S. Pat. No. 5,369,930 is incorporated herein by reference in its entirety as if it were set forth fully herein.

It is an important object of the invention to provide a large hollow panel with a large cavity and orifices to provide a first sound absorbing resonator and a plurality of additional sound resonators held within the cavity for broadband sound absorption.

It is another important object of the invention to join hollow panels to each other to form a larder panel with perimeter means that provides a single large resonator.

A further object of this invention is to provide a hollow core panel such that the panel can also absorb sound energy incident upon both its front and rear external surfaces or its perimeter surfaces.

An additional object of this invention is to provide a hollow core panel such that the design and manufacture of the product can easily be adapted to meet specific performance goals should the need arise.

Another object of this invention is to provide a hollow core panel such that the design of the orifices is easily configured to meet aesthetic requirements.

Another object of this invention is to provide a hollow core panel such that the design may be applied to entirely new installations or to the modification of existing structures.

Yet another object is to provide a sound absorbing structural hollow core panel that can be readily manufactured and installed with a favorable cost of manufacturing and installation as compared to prior art building materials and methods of similar performance characteristics.

SUMMARY OF THE INVENTION

This invention relates to a hollow core panel of structural material having acoustical absorbing properties through the use of the Helmholtz resonator principle. The motivation for the invention is to provide a lower cost, more adaptable means of including effective sound absorption into familiar engineering building elements such as interior walls, exterior privacy walls, or transportation sound barriers. The hollow core panels may be joined together to form a wall or alternatively they may be used individually. The material employed in the panel may have a range of structural characteristics thus allowing for a wide range of structural and non-structural applications. The panel consists of two exterior skins which may or may not be in parallel planes. One or both of the exterior skins contain a plurality of orifices of general shape to communicate acoustical energy incident on the exterior of the panel to the interior region of the panel. The skins are connected about their perimeter to form a single interior cavity or a number of interior cavities. Alternatively a number of the panels with or without individual perimeter boundaries may be joined together to form a larger continuous panel, the larger panel structure being enclosed about its perimeter to form an internal hollow region. Individual panels may contain internal structures which when the panels are joined together to form a wall, a particular arrangement of the interior cavity of the wall is achieved. Thus the panels are a fundamental element to provide an infinitely flexible means to design hollow core sound absorbing walls.

The interior of the panels will generally include pre-formed structures to form communicating cavities again for the purpose of achieving selected sound absorbing goals. These additional interior cavities and respective orifices will have their individual resonant frequencies with the characteristics of the overall panel being the result of a combination of the performance of the individual component behaviors. Sound dissipation material may also be included in the panel's interior spaces. The exterior elements and interior geometries may be made of moldable structural material such as concrete or plastic in a molding or pouring process or may be made from elements which are pre-formed, cut or punched as required.

A sound absorbing hollow core panel of structural material generally has two external skins which may or may not be flat and which may or may not be in parallel planes. In one preferred embodiment of the invention the skins would be made of concrete though there is no intent to limit the design strictly to this material. At least one of these skins may have sound energy incident on it from some external source. If the face or faces of the skins with sound incident on them also has a plurality of orifices which communicate between the exterior of the skins and the interior cavity of the hollow core panel, then the characteristics of the cavity volume together with the orifice number and geometries combine to provide a Helmholtz resonator. The theory for Helmholtz resonators is well known as well as the fact that they may be used to absorb sound in frequency bands defined in part by the resonant frequencies of the resonators. The defining "center frequency" $f_n$ for these resonators is a function of the panel components described above but also may be influenced by treatments of the orifice shape as well as the addition of sound absorbing material such as mineral wool to the interior cavity. In the simplest form where the geometries of the orifices are all the same and the fundamental assumptions of the simple Helmholtz resonator are met, this resonant frequency $f_n$ is nominally given by the formula $f_n=(c/2\pi)(nA/(V(L+\Delta L))^{1/2}$, where c is the velocity of sound in air, A is the cross-sectional area of an orifice, V is the volume of the cavity associated with the orifices, n is the number of orifices, L is the depth of an orifice in a direction normal to the orifice cross-sectional area A and $\Delta L$ is the additional length of an orifice's entrained mass of air, which is proportional to $A^{1/2}$. However, in general, the orifices need not be all the same and the nature of the sound field and panel can be more complex so that a variation on this expression may result.

While the absorption at the resonant frequency is usually very high,the absorption at other frequencies is poor. Numerous attempts have been made to enhance the frequency range over which the sound absorption takes place with some degree of success. In this invention the frequency range is broadened by using the whole of the cavity created by the extent of the wall panel. The larger cavity wall panel provides both stiffness and inertia and thus acoustic waves at various frequencies can be trapped inside the cavity. Once inside the wall panel cavity, the acoustic waves can also be dissipated using various techniques such as sound absorbing materials or other complementing Helmholtz resonators embedded within the above-mentioned cavity and tuned at different complementing frequencies.

One means by which one can enhance the performance of the hollow core panel sound absorbing panel is to employ in the panel cavity a plurality of interior sub-compartments, each with its own respective volume and orifice. The individual sub-compartments' orifices and volumes or sub-cavities are selected with the purpose again to create a plurality of complementing Helmholtz resonator behaviors within the space of a single panel, thus again achieving an effective frequency bandwidth of sufficient breadth over which sound absorption is achieved. These sub-compartments may be manufactured of the same material as the exterior skins or of any material providing sufficient sound transmission loss to enable a separate Helmholtz resonator to be formed. Alternatively, these sub-components may be prefabricated units and installed in the interior of the hollow core panel.

Another arrangement of doing this is to employ a third skin located within the cavity and nominally with the same spatial orientation as the two outer skins. This third skin is located internally with respect to the two outer skins and includes its own particular set of orifices so as to produce a communication between the exterior through the first exterior skin and orifices and the panel interior sub-volumes. This arrangement along with transverse skins and their respective orifices of selected geometries in general can be employed to produce a plurality of volume-orifice combinations which can be employed to produce Helmholtz resonator behavior within the panel centered around a number of complementing frequencies, thus broadening the effective bandwidth over which sound absorption is effectively achieved. These panels may be cast or molded, as with concrete or plastic. Alternatively, these hollow core panels may be prefabricated as with concrete board, plastic, wood or other structural materials, penetrations and other modifications may be performed by cutting or punching.

In general, in the arrangements of the division of the panel interior cavity into its functional sub-components, fundamental acoustical theory teaches that the arrangement of orifices (numbers and geometries) and volumes is selected to achieve a series of resonant frequencies so that in the order of access of the acoustical energy to each sub-component, the resonant frequencies continually descends so that $f_{n1}>f_{n2}> - - - >f_{nM}$, there being M Helmholtz resonator behaviors created in the panel.

Furthermore, one familiar with the art can readily see that wall panels may be manufactured with their individual perimeter enclosures thus creating their respective individual cavities. These individual panels, complete in the concept, may incorporate their respective structural reinforcements such as columns or beams without detracting from the implementation of the concept. Alternatively, one familiar with the art can also appreciate that wall panels without individual perimeter structures can be manufactured and then joined to form a larger wall structure with its own perimeter boundary without the loss of the effectiveness of this concept. The manner in which structural reinforcement within the panels or walls, such as in the form of beams or columns, or along the perimeters are incorporated is completely general and does not detract from this concept. In fact, such structures can be employed in a fashion which complements this concept.

This invention is particularly directed to a generally large, hollow core wall panel of structural material having acoustical absorbing properties through the use of the Helmholtz resonator principle. The motivation for the invention is to provide low-cost, effective sound absorption in familiar engineering building elements such as interior walls of buildings, exterior privacy walls or transportation sound barriers. The relatively larger size of the hollow core wall permits greater flexibility in achieving high acoustical absorption. Furthermore, experience has shown that the use of larger wall panel units versus individual single unit concrete blocks in building walls is usually more cost effective. The hollow core wall panels which are in general large, may be joined together to form an extended wall or alternatively they may be used individually. The material employed in the panel may have a range of structural characteristics, thus allowing for a wide range of structural and non-structural applications.

The hollow core wall panel consists of two exterior skins which may or may not be in parallel planes. The skins are generally large relative to the thickness of the panel and are not integrally formed but are connected or at least enclosed about their perimeter by perimeter skins or structural members to form a single interior cavity. The size of the sound absorbing hollow core wall panels generally corresponds to that of a whole integral wall, that is much larger than a single unit concrete building block normally found in common construction methods. The thickness of the hollow core wall panel is, however, of the same order as the concrete building blocks. Additionally, a number of the hollow core wall panels without individual perimeter skins may be joined together to form a larger continuous wall panel enclosing a larger interior cavity, the larger wall panel structure being enclosed about its perimeter by perimeter skins or structural members. One of the exterior skins contains a plurality of orifices to communicate acoustical energy incident on the exterior of the hollow core wall panel to the interior cavity formed by the two exterior skins and the perimeter skins. The volume of the interior cavity and the number, shape, and size of orifices are selected to provide sound absorption in the region of a selected frequency. Because of the available large interior cavity which can be arranged to suit various sound absorption requirements, the wall panels provide an infinitely flexible design.

In order to broaden the frequency range over which sound is absorbed, the interior cavity contains pre-formed structures or sub-volumes with single or multiple orifices to form communicating cavities with the internal cavity for the purpose of achieving selected sound absorbing goals. These additional interior cavities and respective orifices will have their own individual resonant frequencies with the characteristics of the overall panel being the result of a combination of the performance of the individual component behaviors. Sound absorption material may also be included in the panels' and sub-volumes' interior spaces. The wall panel skins or interior geometries may be made of moldable structural material such as concrete or plastic in a molding or pouring process or may be made from skins which are pre-formed and then cut or punched for these purposes.

These hollow core wall panels may have typical areas of 4 feet by 8 feet or larger for building structures and as large as 20 feet by 18 feet for highway walls. This makes them distinct from, and less expensive than, conventional concrete blocks. The larger area provides for more flexibility by which the hollow core wall panel can be made sound absorbing.

The trapping of the sound waves inside the hollow core wall internal cavity at the relevant audio frequencies is possible because of the large internal cavity formed by the relatively large integral wall panels (4 feet by 8 feet or larger). Because of the cavity size, the air inside the cavity has not only compliance but also inertia, thus trapping acoustic waves for dissipation.

The relatively larger size of the hollow core wall permits greater flexibility in achieving high acoustical absorption. Furthermore, experience has shown that the use of larger wall panel units versus individual single unit concrete blocks in building walls is usually more cost effective.

By way of example, one embodiment of the hollow core sound absorbing highway wall panel consists of two skins, each one and one-half inches thick and 10 feet high by 20 feet long. The hollow core wall panel would be formed with each skin poured and cured separately and then joined by interior spacers and bounded by a perimeter skin forming a nominally 5 inches thick air cavity. One of the skins would be formed with 400 equally spaced slits or orifices (2 orifices per square foot), ¾ inch wide and 7 inches long. The resonant frequency of the formed Helmholtz resonator by the exterior skins with orifices and the internal air cavity would be on the order of 128 Hz. Complementing Helmholtz resonators to enhance the sound absorption characteristics of the hollow core wall panel can be introduced by adding one or more pre-made or cast-in-place individual sub-volume structures. A typical sub-volume structure may be ten feet long and generally semi-cylindrical in shape, and capped at the ends with fifteen (15) one-half inch by six inch orifices, and a wall thickness of one-half inch. The uncoupled resonant frequencies of two complementing Helmholtz resonators formed by the sub-volume structure and the remainder of the internal cavity are respectively 185 Hz and 245 Hz. An extension of the above embodiment, representing a special case of introducing sub-volume structures in one or both of two serial cavities would be to include in the internal cavity a third 10 feet high by 20 feet long skin, one-half inch in thickness, parallel to and one and one-half inches from the exterior skin with orifices. The interior skin has multiple orifices of the same size and number as the exterior skin. In this configuration, the uncoupled resonant frequencies of the two complementing Helmholtz resonators formed by the first and second interior cavities are respectively 234 Hz and 192 Hz. Sub-volume structures in each cavity will resonate at their respective natural frequencies to absorb sound, thus providing efficient broadband sound absorption.

The use of the relatively large panels permits a broad range of internal arrangements to be used to develop tailored acoustical performance in a cost effective fashion. The larger size of the hollow core wall panel makes it amenable to mechanized methods of wall construction which would contribute to lower costs as compared to more labor intensive means of wall construction. The use of the Helmholtz resonator principle makes it feasible to build large absorber units out of low cost construction material, such as concrete. Compared to fibrous sound absorbing material covered with perforated steel panels for protection from environmental conditions, the sound absorbing hollow core wall panels, which are very rugged due to the use of construction material, are significantly more cost effective.

The 10 feet high by 20 feet long sound absorbing hollow core wall panels can be installed with appropriate columns and foundations and joined end to end to form a 10 feet high wall of any desired length. Additionally, walls higher than 10 feet could be formed by placing 20 feet long hollow core wall panels atop one another with appropriately suitable structural supports. The upper and lower wall panels can form two separate cavities isolated from each other or can form one larger cavity by removing the perimeter means between the panels where they join. The use of large concrete panels in htis instance would greatly reduce the cost of sound absorbing wall as compared to a wall of sound absorbing masonry blocks or a metal wall with perforated surface and a fibrous sound absorbing filler material. Similarly, in the construction of large interior spaces, such as gymnasiums or warehouses, large hollow core absorbing wall panels, as described here, represent a cost effective alternative to present construction and sound absorbing products.

It is important to note at this point that this flexibility and robustness of the panel to support a broad frequency band absorptive character is an important feature of the invention over other Helmholtz based inventions which due to their nature are limited in their flexibility. It is further important to note that this flexibility and robustness of concept then support a flexibility in design, manufacture and installation of the sound absorbing hollow core wall which is unique from other Helmholtz based inventions intended for use in sound absorption.

DETAILED DESCRIPTION OF THE PREFERRED EMBODIMENTS

Figure 1:
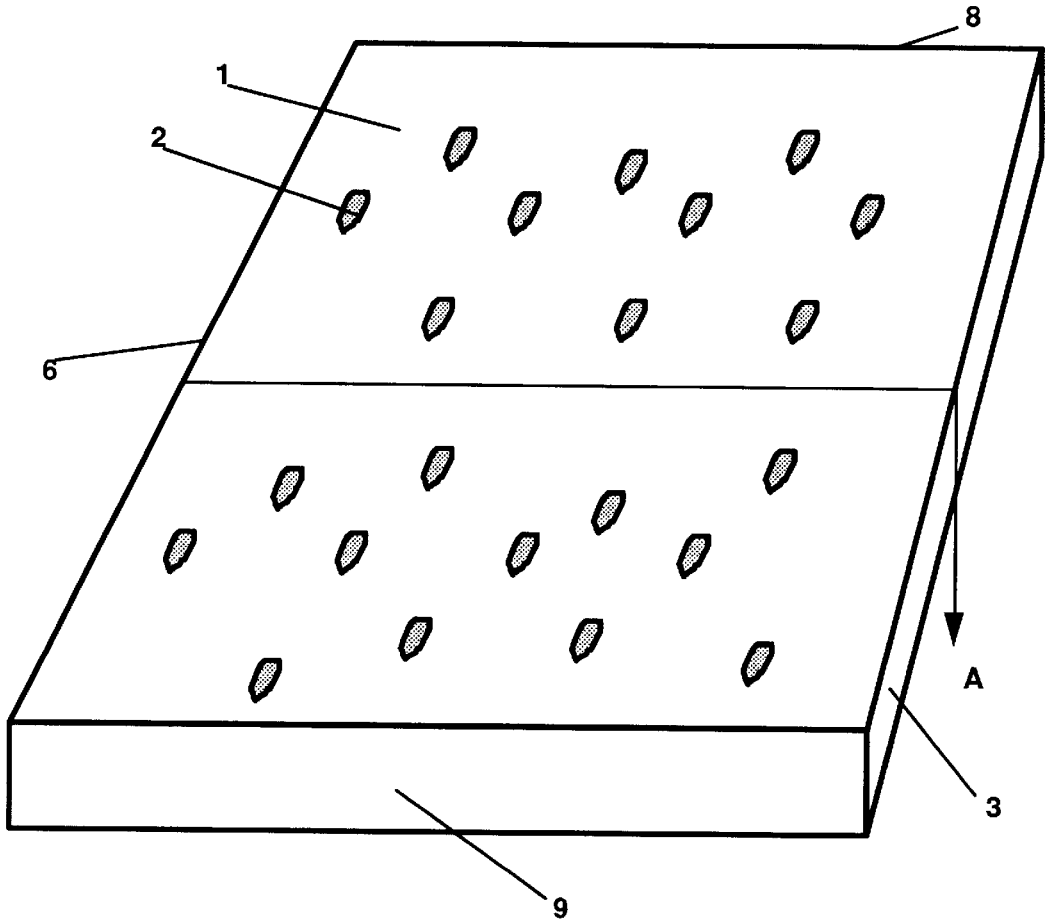
FIG. 1 is a perspective view of a sound absorbing hollow core panel illustrating the invention.
Figure 2:
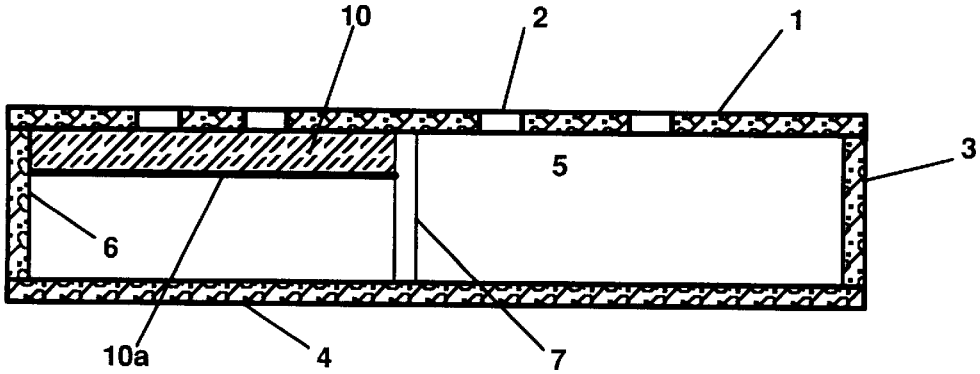
FIG. 2. is a section view of a single cavity sound absorbing hollow core panel.

FIG. 1 shows a perspective view of a sound absorbing panel with its sound absorbing face 1 oriented in a generally upward direction for the purposes of the illustration. FIG. 1 also illustrates the orifices 2 in the upper skin together with the perimeter structure sides 3,6 top 8 and bottom 9. The second exterior skin 4 is under the panel and consequently is not visible in the figure. FIG. 2 illustrates one preferred embodiment of the invention which may have two parallel exterior facing skins 1,4 joined by spacers 7 and bounded by a perimeter created by vertical columns 3,6 at either horizontal end, a top horizontal beam 8 and the foundation 9 along the horizontal bottom.

These basic panel elements or their variations then can be employed to form a wall segment of some height and length. One of the external skins 1 will have a plurality of orifices 2 communicating the acoustical energy from the exterior to the interior cavity 5 of the panel. The width of the wall, the thickness of the skins 1, the number and size of the interior spacers 7, and the number and geometries of the orifices 2 on one side are defined by the structural requirements of the panel and its desired sound absorbing characteristics. The panel of FIG. 2 will have a single nominal Helmholtz resonant frequency $f_n$ and depending on the character of the orifices and the sound absorbing material placed in the cavity 5 an effective frequency bandwidth, BW, over which it will be an effective absorber of sound. The panel might also be a component of a wall where it is placed atop a similar panel with appropriate structural supports, with its lower perimeter boundary being coincident with the upper horizontal perimeter of the lower panel. In this way walls of substantial height or length can be created which will absorb sound. To one skilled in the art the generalization of the perimeter components beyond this preferred embodiment can be readily seen.

In a second preferred embodiment of the invention included in FIG. 2, one may envision any of the above or following preferred embodiments to include sound absorbing material 10 within the respective cavities of the panel to enhance the sound absorption coefficient and contribute to a broader effective frequency bandwidth. The backing of the sound absorbing material 10*a* may be selected to be of such a weight and stiffness so as to provide an "effective resonator" behavior within the cavity in a fashion congruent with the concept of creating a number of complementing resonant behaviors in the cavity.

Figure 3:
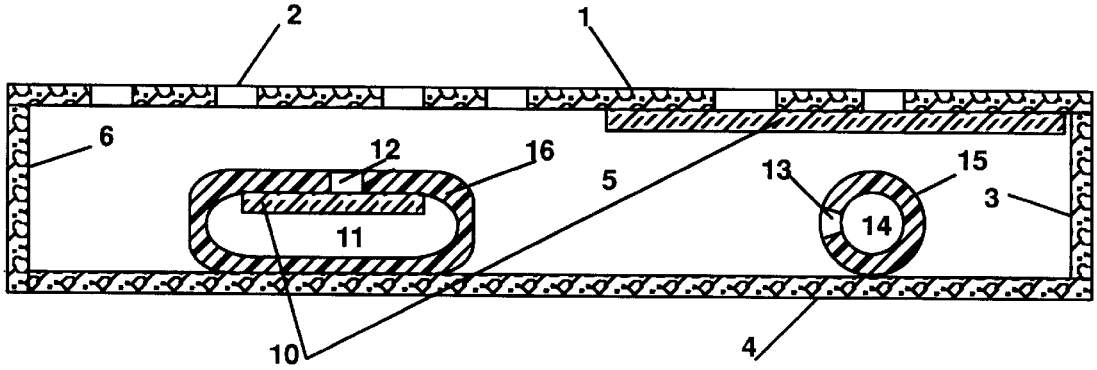
FIG. 3 is a section view of a sound absorbing hollow core panel with internal sub-volumes with orifices.

In a third preferred embodiment of the invention, shown in FIG. 3, one may have two parallel exterior skins 1,4 and bounded by a perimeter 3,6 created by a structural material with one of the skins 1 having a plurality of orifices 2 facing a noise source. The interior cavity 5 includes a plurality of sub-volumes or sub-cavities 11,14 formed by pre-formed shells 15,16 of material with sufficient mass and stiffness and having individually selected orifice geometries 12,13 so as to achieve a number of resonating frequencies M for the selected Helmholtz systems. The interior sub-volumes 11,14 communicate with the exterior sound field first through the orifices 2 of the exterior skin 1 and then their respective orifices 12,13 In this way a series of overlapping frequency bands may be created or a single particular frequency band is enlarged, thus producing a frequency tuned or broad frequency band sound absorbing hollow core panel.

In the simplest form these resonant frequencies are nominally given by the formula $f_{ni}=(c/2\pi)(n_iA_i/V_i(L_i+\Delta L_i))^{1/2}$, i=1,2, where c is the velocity of sound in air, $A_i$ is the cross-sectional area of an orifice, $V_i$ is the volume of the cavity associated with the particular orifices, $n_i$ is the number of orifices, $L_i$ is the depth of an orifice in a direction normal to the orifice cross-sectional area $A_i$ and $\Delta L_i$ is the additional length of an orifice's entrained mass of air, which is proportional to $A_i^{1/2}$. The relative sizes of the volumes, numbers of orifices and geometries of the orifices are chosen so as to achieve the desired operating frequency bandwidth of sound absorption. The number of resonant frequencies can be extended beyond two with this approach. For the hollow panel with these two volumes, the cavities are acoustically coupled so that in the simplest form, the panel exhibits two resonant frequencies $f_{nI}$ and $f_{nII}$ nominally given by the expressions:

$$fnI=[f_{n1}^2/2+f_{n2}^2-(f_{n1}^4/4+f_{n2}^4)^{1/2}]^{1/2}$$

$$fnII=[f_{n1}^2/2+f_{n2}^2+(f_{n1}^4/4+f_{n2}^4)^{1/2}]^{1/2}$$

To those experienced in the art it will be recognized that in many real world situations the possible complexity of the acoustic fields can result in these expressions becoming approximations of the panels actual behavior, with some changes to these expressions being expected depending on the characteristics of the sound field. However, for practical situations, the expressions provide sufficient guidance for design. The results of practice indicate that the degree of structural alteration of the panel skins due to the size and numbers of orifices required results in acceptable changes in the structural characteristics of the panel overall.

Figure 4:
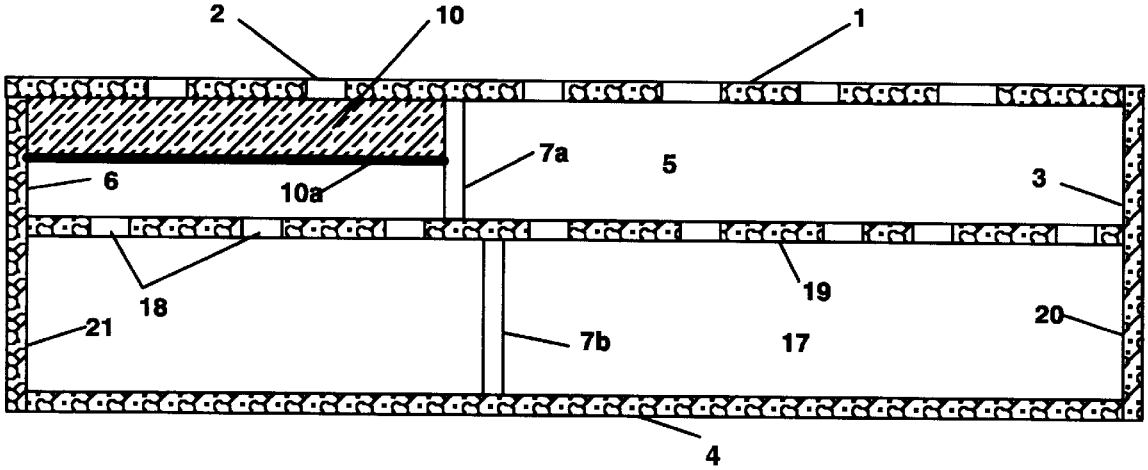
FIG. 4 is a section view of a multiple cavity sound absorbing hollow core panel with a transverse interior skin.

As shown in FIG. 4, in a fourth embodiment of the invention the internal cavities 5 and 17 as are formed by a third internal skin 19. In this embodiment of the invention one may have three parallel skins, two external skins 1,4 and an internal skin 19, and bounded by a perimeter created by vertical columns 3,6,20,21 at either horizontal end, a top horizontal beam 8 and the foundation 9 along the horizontal bottom. Elements 3 and 6 and or 20 and 21 may be separate or integral. One of the external skins 1 or 4 will have a plurality of orifices 2 facing an acoustic field. The interior of the panel is divided by a third skin 19 internally located and parallel to the two exterior skins. Internal spacers or skins 7*a* and 7*b* may be employed, they not necessarily being the same size, geometry or material. The orientation of the interior skin 19 is such that in general it is closer to the exterior skin 1 and that the volume of the cavity 5 together with the orifices 2 define a first nominal uncoupled resonant frequency $f_{n1}$. The cavity 17 between the interior skin 19 and the exterior skin 4 together with the character of the orifices 18 serve to define a second nominal uncoupled resonant frequency $f_{n2}$ which is less than $f_{n1}$.

Figure 5:
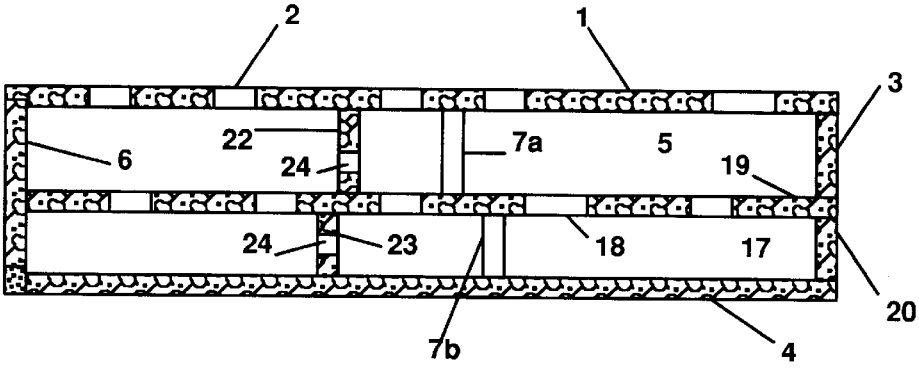
FIG. 5 is a section view of a sound absorbing hollow core panel with lateral and transverse interior skins.

In the embodiment of the invention shown in FIG. 5 interior partitions 22 and 23 With respective orifices 24 are included to further introduce more complex series of resonant cavities in the two major lateral cavities formed by the major interior skin 19.

Figure 6:
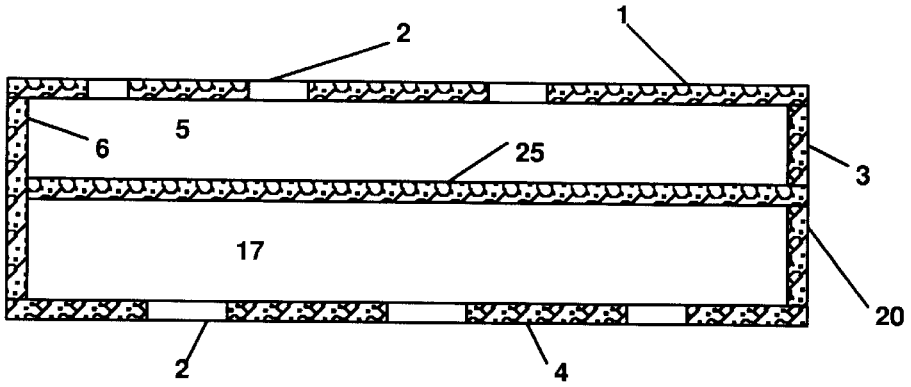
FIG. 6 is a section view of a sound absorbing hollow core panel with sound admitted through both exterior skins.

In the embodiment of the invention illustrated in FIG. 6, one may have three parallel skins, two external skins 1,4 and an internal skin 25, and bounded by a perimeter created by vertical columns at either horizontal end, a top horizontal beam and the foundation along the horizontal bottom. Both of the external skins will have a plurality of orifices 2 facing noise sources while the interior skin will not have orifices. In this manner a panel with sound absorption on both sides is achieved while preserving an adequate panel sound transmission loss. This concept is useful in interior walls between rooms of a building and in median strip barriers of a highway to absorb noise emanating on either side of the wall.

In the embodiment of the invention, one may envision the joining of individual panels one to another with or without their respective perimeter structures to form a wall of greater size. The interior volume of the wall is then defined by the total interior volumes of the individual panels thus providing an infinite degree of flexibility in designing the acoustical absorbing characteristics of the wall through the combined effect of the coupled panels.

Figure 7:
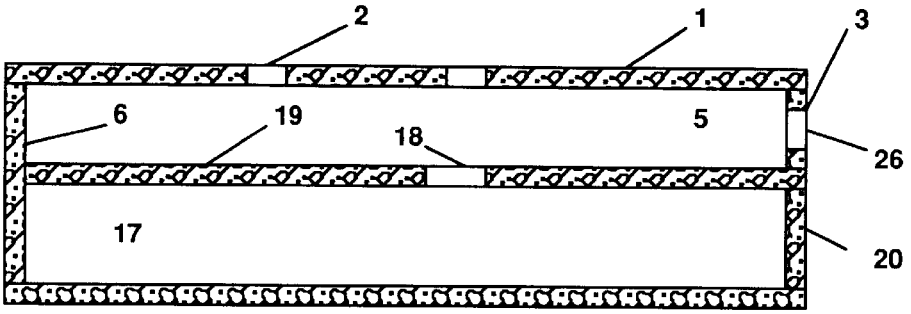
FIG. 7 is a section view of a sound absorbing hollow core panel with sound admitted along the perimeter.

In the embodiment of the invention shown in FIG. 7, one may envision the perimeter 3 to contain a plurality of orifices 26 providing communication with single or multiple interior cavities, thus creating a panel with sound absorption along its perimeter.

In one embodiment of the invention, one may envision the addition of any of the above preferred embodiments but absent the second exterior skin 4. This configuration can be attached to the interior or exterior surface of an existing wall which then serves as the second external or rear skin. Thus existing acoustical hard walls may be treated by attaching on to them a variety of several embodiments in a modification to provided sound absorption to existing structures. For example, a plurality of skins 1 can be attached to an existing wall and to each other to form an enlarged cavity defined by the skins 1, the existing wall and a perimeter means around the outer perimeter of the abutting skin structure.

Figure 8:
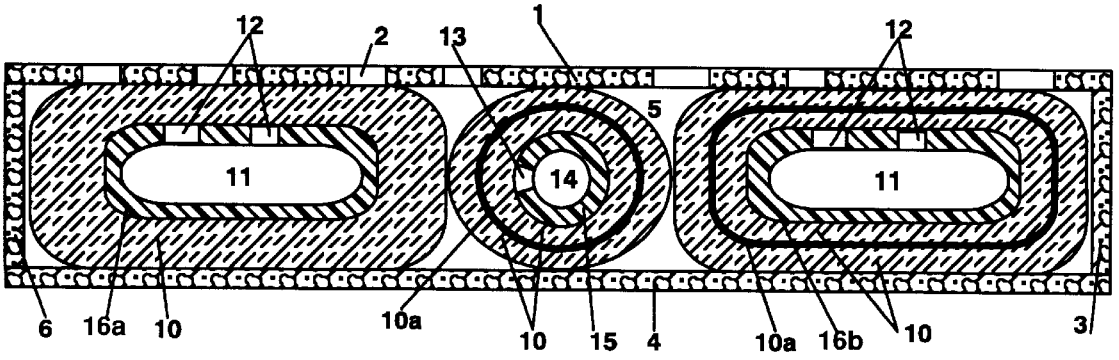
FIG. 8 is a section view of a sound absorbing hollow core panel with internal sub-volumes adapted to be slidably received within the panel and held by friction between the skins.

FIG. 8 is a cross section of a hollow core wall panel having three acoustic resonator sub-volumes formed by preformed shells 15, 16*a*, and 16*b*, e.g. fiber reinforced plastic inserted into its cavity 5. Each of the shells is wrapped in a fibrous acoustic absorption material 10. Shells 15 and 16*b* have a limp septum layer 10*a* wrapped around the material 10 to further enhance the acoustic absorption characteristics of the wall panel and a further layer of fibrous material around the limp septum layer. In each instance, the outer layer of fibrous material is held against the skins 1 and 4 and preferably against the orifices 2 and also serve to hold the sub-volumes in place within the wall panel. This embodiment greatly reduces the volume of the cavity 5 because the volumes of the sub-volumes is subtracted from the total interior space within the wall panel to determine the effective volume of cavity 5. This in turn significantly raises the natural resonant frequency of the acoustic resonator defined by the skins 1 and 4, the perimeters 3, 6, 8, 9, and the orifices 2 in spite of its large dimensions.

Only three sub-volumes 15, 16*a*, and 16*b* are shown to define three additional acoustic resonators, but it will be understood that, because of the large volume within the wall panel, a large number of sub-volumes with different resonant frequencies can be slidably inserted therein. The frequencies of applicants' resonators defined by the cavity 5 and its orifices and those of the sub-volumes need not occur in cascading order as taught by the prior art. The sub-volume frequencies need merely to be lower than the effective frequency of the cavity 5 and its orifices. Each sub-volume independently communicates with the cavity 5, eliminating the requirement of cascading frequencies, thus making the improved structure much more flexible. Thus, structural means defining sub-volumes can easily achieve acoustic absorption at important audible frequencies. Even positioning of the sub-volumes is completely flexible.

Hence, an extremely large wideband frequency absorber is described.

Attention is directed to the fact that FIGS. 8–13 are not drawn to scale, rather they illustrate general concepts.

Figure 9:
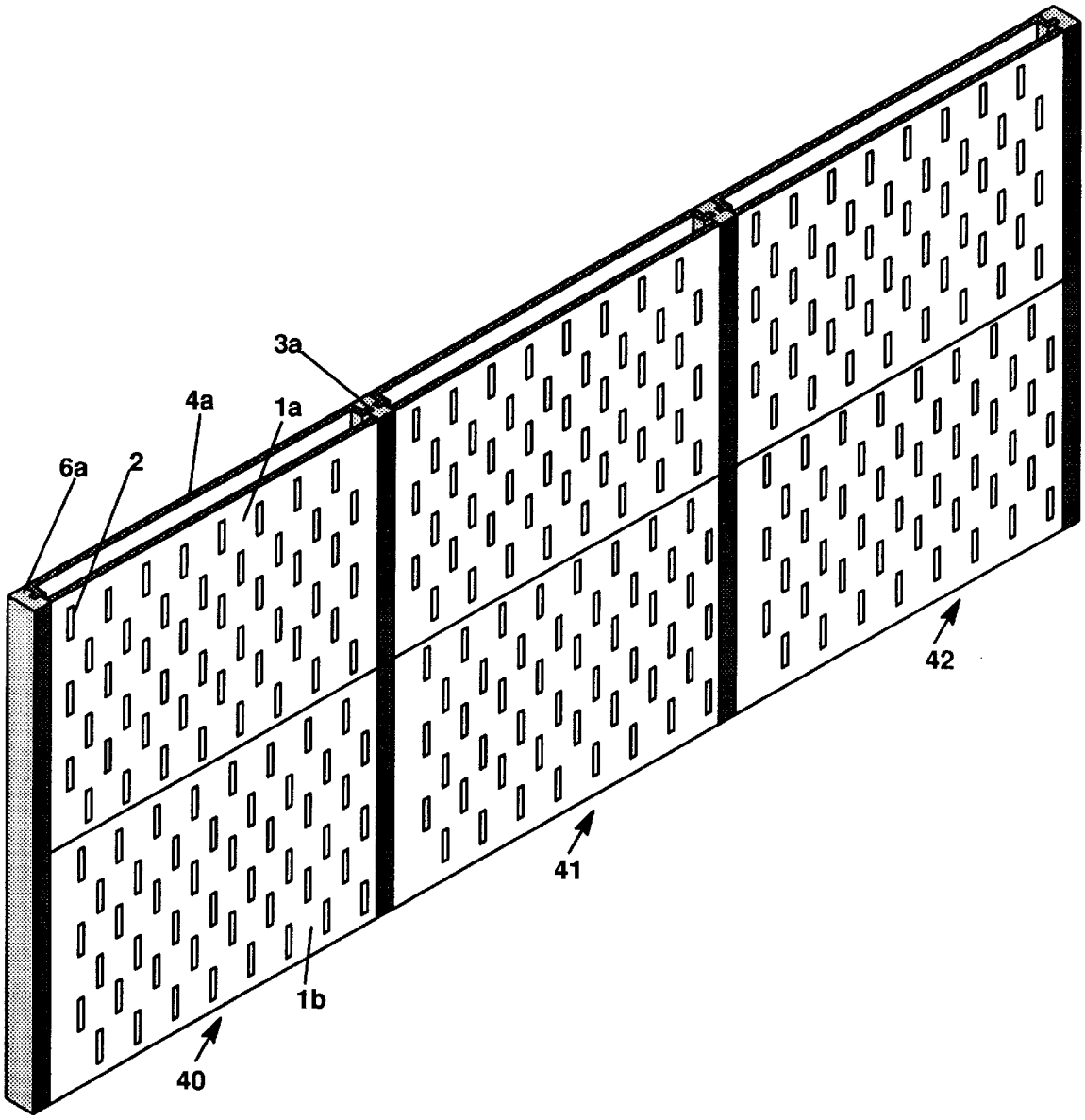
FIG. 9 is a perspective view of a section of a highway noise barrier comprising three panels constructed in accordance with the teachings of the present invention.
Figure 10:
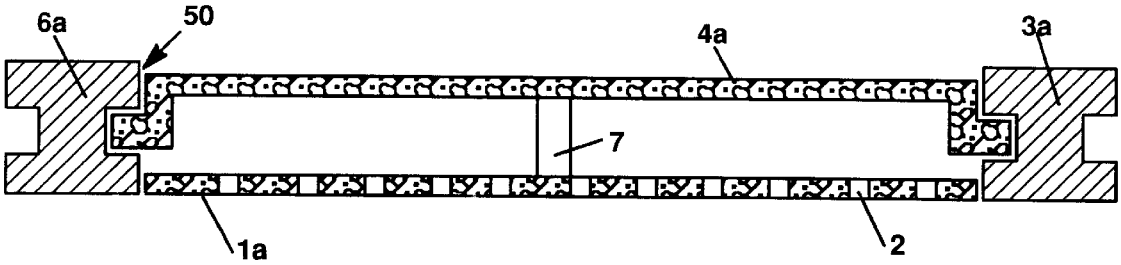
FIG. 10 is a section view illustrating one preferred column support structure for the panels of FIG. 10.

FIGS. 9 and 10 illustrate three sections 40, 41, 42 of a highway noise barrier constructed in accordance with the teachings of this invention. Each section, for example 40, is comprised of two vertically stacked sub-panels, having front skins 1*a*, 1*b* and rear skins 4*a* and 4*b* (not shown) and H-type columns 3*a*, 3*b* forming side perimeter means. The stacked sub-panels form one continuous cavity therein. The columns are driven into the ground to an appropriate depth to support the sub-panel in a generally vertical position. The ground can provide the lower perimeter means and a top beam (not shown) can provide the top perimeter means.

There can be small clearances 50 between the H-type columns and sub-panels and minor air passage at the top and bottom of each section without significantly affecting the effectiveness of the acoustic resonator formed by each pair of vertically stacked sub-panels.

It can be appreciated that this structure is very cost effective from an installation viewpoint—reasonably comparable to that of solid walls. It merely entails installing the H-type columns as is presently done in noise barriers, then sliding the sub-panels into the slots in the columns and placing a beam on the open top of each section.

However, a preferred embodiment includes sub-volumes as illustrated in FIG. 8. The sub-volumes are merely forced into the panel cavity prior to installing the top beam.

Figure 11:
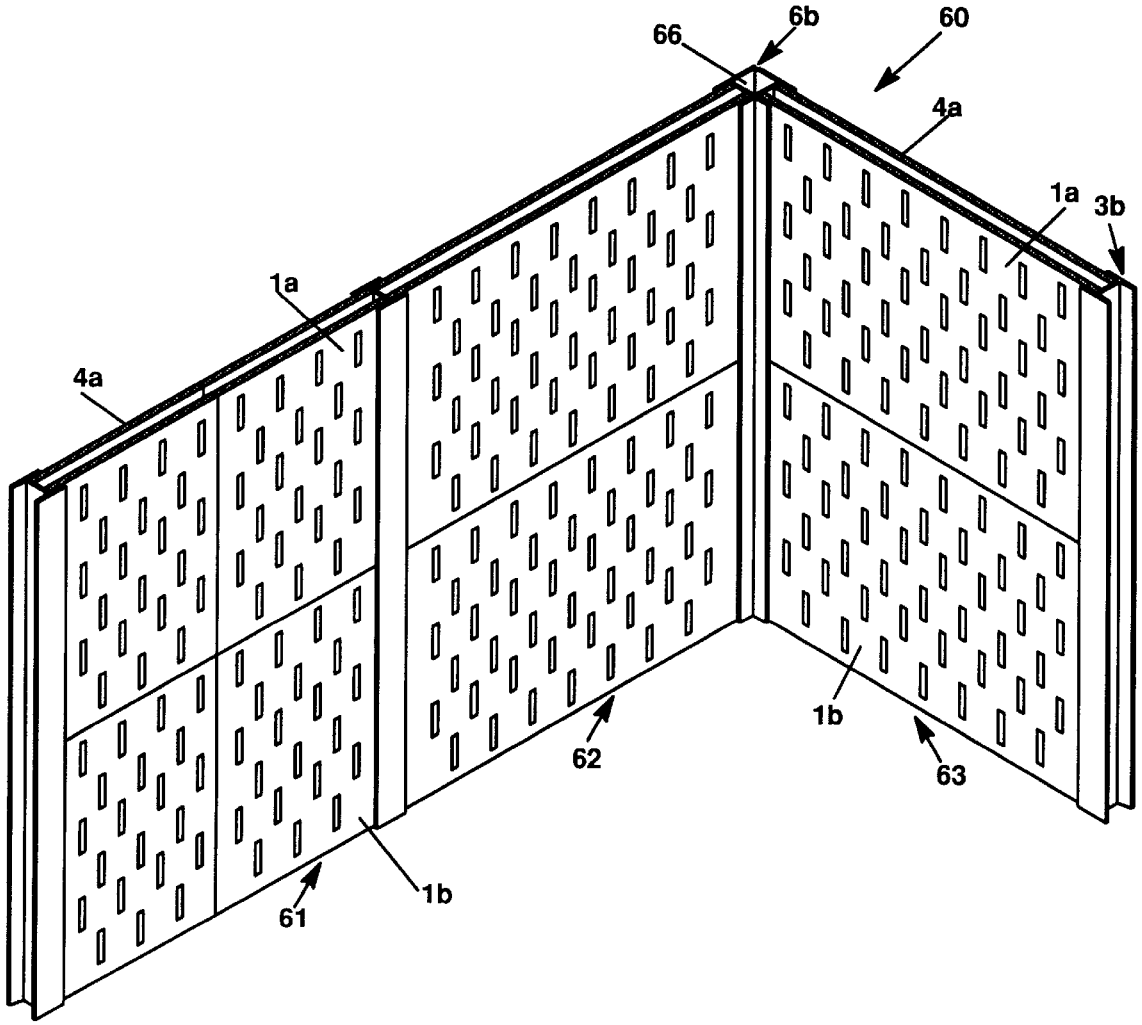
FIG. 11 is a perspective view of a pair of adjoining walls of a building comprising panels constructed in accordance with the teachings of the present invention.
Figure 12:
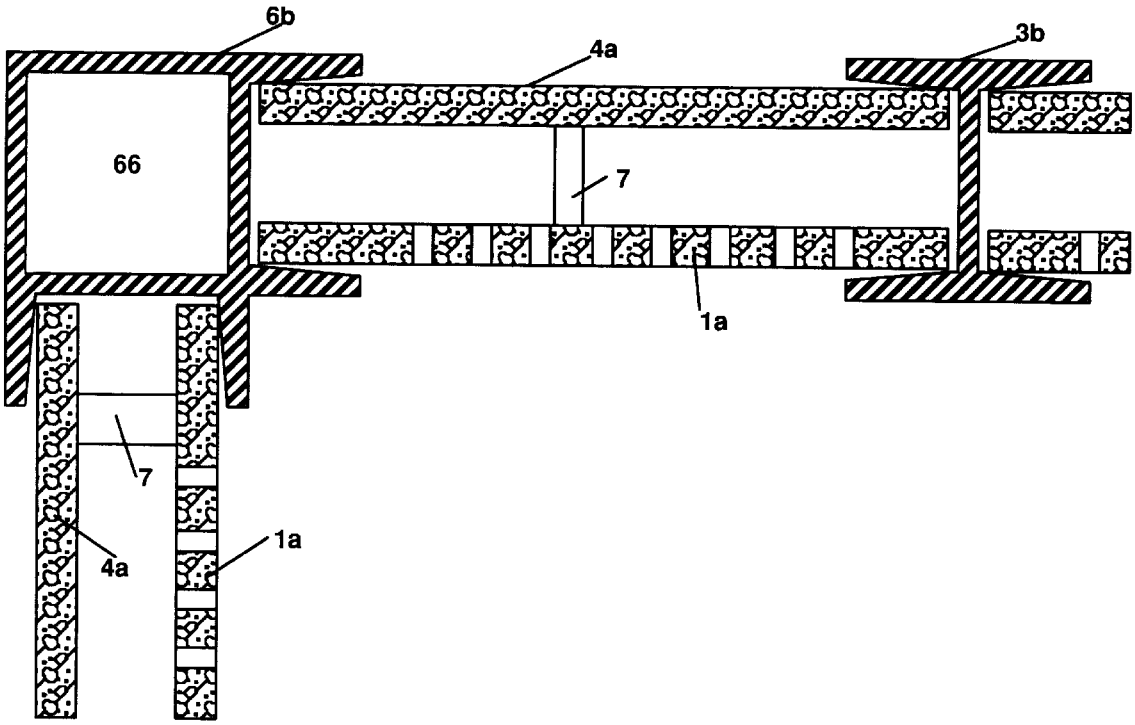
FIGS. 12 and 13 respectively are section views illustrating support column structures for extending cavity volumes vertically and horizontally using sub-panels to form panels in FIG. 11.
Figure 13:
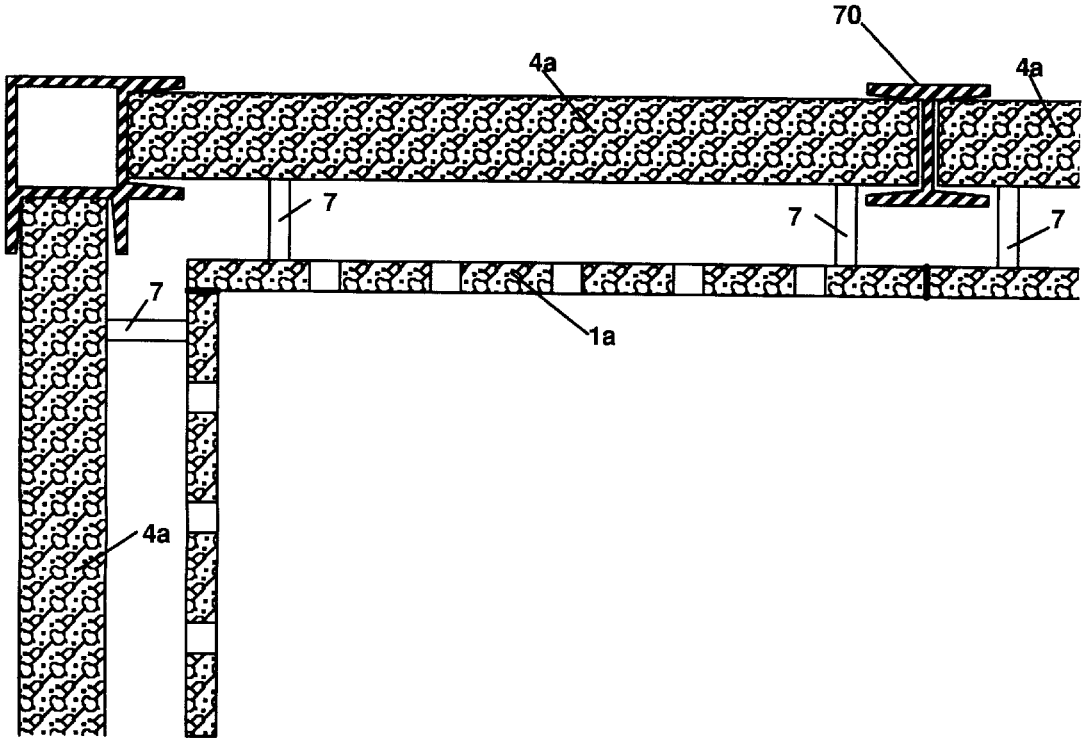

FIGS. 11–13 illustrate the construction of walls of a new building using the teachings of the present invention. FIGS. 11 and 12 show a portion of a building 60, including wall sections 61, 62, 63. Each wall section, such as 63, is comprised of two vertically stacked sub-panels held between a column 3*b* and a special column structure 6*b*. The columns are set in a building foundation (not shown) and the wall panels comprising skins 1*a*, 1*b*, 4*a*, 4*b* are lowered into the column slots. Concrete is typically poured into the space 66 of column structure 6*b* for strengthening the walls. Sub-volume structures such as those shown in FIG. 8 are dropped into the space between the skins 1*a*, 1*b*, 4*a*, 4*b* and a beam is affixed to the top of the section 63.

FIG. 13 is illustrative of a column 70 support column for stacking sub-panels vertically and/or horizontally to create a continuous cavity between sub-panels. Column 70 receives the ends of two horizontally adjacent sub-panel skins 4*a* and can receive vertically adjacent sub-panel skins 4*a*, 4*b*.

FIG. 13 also illustrates a corner column structure providing a continuous cavity for two adjacent wall sub-panels horizontally stacked at 90° to each other. It can also receive vertically attached sub-panels.

Hence, it can be seen by just these few illustrations that applicants' unique wall panels and sub-panels are very versatile for constructing walls of various types where effective sound absorption is a requirement.

Although the invention has been described in terms of preferred

We claim:

1. A sound absorbing wall panel comprising:

an external Helmholtz acoustical resonator including a front skin of the panel adapted to face a source of noise;

a back skin of the panel held in spaced relation to the front skin;

perimeter structure between the skins and orifices in the front skin to permit sound waves to enter into a cavity between the skins and perimeter structure;

a plurality of internal Helmholtz acoustical resonators enclosed within the cavity and having respective differing natural frequencies within a predetermined bandwidth of said noise;

said external acoustical resonator having a natural frequency within said bandwidth and higher than said respective natural frequencies;

said higher frequency determined by said orifices and the volume of said cavity less volumes of the internal acoustical resonators;

said internal acoustical resonators adapted to be slidably inserted into and randomly positioned within said cavity;

so that said acoustical resonators of the panel dissipate significant levels of sound energy at and about said higher and respective lower natural frequencies.

2. A broadband sound absorbing wall panel comprising:

a first Helmholtz acoustical resonator including;

a front skin of said panel adapted to face a source of noise having a bandwidth;

a back skin of said panel held in spaced relation to the front skin;

perimeter structure between the skins; and a cavity within the resonator in communication with the source of noise via external orifices in the front skin;

at least one additional Helmholtz acoustical resonator enclosed within the cavity and including a sub-cavity therein in communication with the cavity via internal orifices in a wall of the additional acoustical resonator;

said first acoustical resonator having a first natural frequency in said bandwidth determined by said external orifices and the volume of the cavity less the volumes of each additional resonator; and each additional acoustical resonator having a respective different second natural frequency lower than the first natural frequency and in said bandwidth determined by the internal orifices and the volume of the sub-cavity, so that significant noise energy is dissipated by the wall panel at and about said first and second natural frequencies.

3. A sound absorbing wall panel comprising:

a first means, adapted to face a source of noise, for dissipating significant levels of sound energy at and about a respective first resonant frequency within a predetermined bandwidth of said noise; and a plurality of second means, enclosed within said first means, for dissipating significant levels of sound energy at and about respective differing resonant frequencies lower than said first resonant frequency and within said bandwidth.

4. The wall panel of claim 3 wherein each second means is adapted to be slidably inserted into and randomly positioned within the first means.

5. A sound absorbing wall panel adapted to face a source of noise comprising:

a first acoustic resonator for dissipating significant levels of sound energy at and about a respective first resonant frequency within a bandwidth of said noise;

at least one additional acoustic resonator enclosed within said first acoustic resonator for dissipating significant levels of sound energy at and about a respective resonant frequency lower than said first resonant frequency and within said bandwidth.

6. The wall panel of claims 5 wherein each additional acoustic resonator is adapted to be slidably inserted into and randomly positioned within said first acoustic resonator.

* * * * *